US012582886B2

(12) United States Patent
Lucheon

(10) Patent No.: US 12,582,886 B2
(45) Date of Patent: Mar. 24, 2026

(54) SWIM TRAINING APPARATUS

(71) Applicant: Jacob Michael Lucheon, Westfield, IN (US)

(72) Inventor: Jacob Michael Lucheon, Westfield, IN (US)

( * ) Notice: Subject to any disclaimer, the term of this patent is extended or adjusted under 35 U.S.C. 154(b) by 880 days.

(21) Appl. No.: 17/876,922

(22) Filed: Jul. 29, 2022

(65) Prior Publication Data

US 2023/0034685 A1 Feb. 2, 2023

Related U.S. Application Data

(60) Provisional application No. 63/226,876, filed on Jul. 29, 2021.

(51) Int. Cl.
*E04H 4/14* (2006.01)
*A63B 69/12* (2006.01)

(52) U.S. Cl.
CPC ..... *A63B 69/12* (2013.01); *A63B 2209/00* (2013.01); *A63B 2225/605* (2013.01); *E04H 4/143* (2013.01)

(58) Field of Classification Search
CPC ..... E04H 4/143; E04H 4/14; A63B 69/12; A63B 2209/00; A63B 2225/605; A63B 2071/0694
See application file for complete search history.

(56) References Cited

U.S. PATENT DOCUMENTS

| | | | | |
|---|---|---|---|---|
| 6,840,830 | B1 * | 1/2005 | Harlan | A47C 15/006 441/35 |
| 2013/0280972 | A1 * | 10/2013 | Cheung | A63H 23/10 441/129 |
| 2017/0067267 | A1 * | 3/2017 | Gallo | E04H 4/143 |
| 2021/0185300 | A1 * | 6/2021 | Firmin | G03B 17/561 |

* cited by examiner

*Primary Examiner* — Andrew Polay
(74) *Attorney, Agent, or Firm* — Taft Stettinius & Hollister LLP; Derek B. Lavender

(57) ABSTRACT

A swim training apparatus that has a body section defined along a longitudinal axis and a coupling section configured to couple the swim training apparatus to a buoy line in a first orientation and a second orientation. In the first orientation the longitudinal axis of the body section is substantially parallel with the buoy line and in the second orientation the longitudinal axis of the body section has an offset angle relative to the buoy line.

18 Claims, 10 Drawing Sheets

SWIM TRAINING APPARATUS

CROSS-REFERENCE TO RELATED DISLCOSURES

The present disclosure claims the benefit of U.S. Provisional Application No. 63/226,876 filed on Jul. 29, 2021, the contents of which are incorporated herein in entirety.

TECHNICAL FIELD

The present disclosure relates to a floating barrier for swim training and more specifically to a floating barrier that can be stored on a swimming lane without substantially extending into the swimming lane.

BACKGROUND

Often in swim training, it is desirable to provide a marker in the swim lane to identify the length of the lane the swimmer spends underwater or otherwise mark lengths along the swim lane. Current designs are intended to be stored outside of the pool, and are not practical, durable, or user friendly. These solutions fail to meet the needs of the industry because they require storage space, take time to put in the pool, and must be returned to storage when done. The current solutions take too much storage space, they are not easy to use, and therefore waste a lot of the user's time and effort to be implemented.

There currently exists a need in the swimming community for a device that can be used as a physical barrier to help swimmers train and that can be stored on the swimming lane line to save time and resources.

SUMMARY

One embodiment is a swim training apparatus that has a body section defined along a longitudinal axis and a coupling section configured to couple the swim training apparatus to a buoy line in a first orientation and a second orientation. In the first orientation the longitudinal axis of the body section is substantially parallel with the buoy line and in the second orientation the longitudinal axis of the body section has an offset angle relative to the buoy line.

In one example of this embodiment, the offset angle is between about eighty-five degrees and about ninety-five degrees. In another example, the coupling section comprises a first leg and a second leg. In part of this example, the first leg has a first slot and the second leg has a second slot, the first and second slot configured to allow the buoy line to be positioned therein when the swim training apparatus is in the second orientation. In one aspect of this part, the first and second slot have an inverted J-shaped profile. In another part of this example, the first and second leg are separated by a gap sized to allow at least one buoy on the buoy line to be positioned therein when the swim training apparatus is in the second orientation. One aspect of this part has a buoy section spanning the first leg and the second leg. Further, the buoy section has a buoy slot defined therein, the buoy slot configured to allow the buoy line to be positioned therein when the swim training apparatus is in the first orientation. In this part, the buoy slot has an inverted J-shaped profile.

In another example of this embodiment, the body section has a concave cross-section configured to allow a four-inch buoy to be positioned at least partially therein in the first orientation. In yet another example, the swim training apparatus is formed of a buoyant material. In one aspect of this example, the swim training apparatus is formed of expanded polypropylene foam.

In yet another example, the coupling section has elongated side sections relative to the body section configured to increase the buoyancy of the coupling section. Another example has an indicia section on the body section configured to display advertising indicia. In yet another example, the body section has a concave cross-section configured to allow a six-inch buoy to be positioned at least partially therein in the first orientation.

Another example of this embodiment has an outer coating substantially surrounding the outer surface of the swim training apparatus, wherein the outer coating is formed of a different material than the body section. In one aspect of this example, the outer coating is formed of nylon.

Yet another example has a buoy section at one of a first end or a second end of the swim training apparatus. In part of this example, the buoy section has a buoy slot defined therein, the buoy slot configured to allow the buoy line to be positioned therein when the swim training apparatus is in the first orientation. Another part of this example has a buoy section at both the first end and the second end. In one aspect of this part, each buoy section has a buoy slot defined therein, the buoy slot configured to allow the buoy line to be positioned therein when the swim training apparatus is in the first orientation. Further, in this aspect each buoy slot has an inverted J-shaped profile.

In yet another example of this embodiment the coupling section has a first and second clip configured to be selectively coupled to the buoy line. The first and second clip are both coupleable to the buoy line in both the first orientation and the second orientation. In part of this example, each of the first and second clip is coupled to the body section with an elastic line. The elastic line is coupled to the body section through a through hole.

Another part of this example has a buoy section at one end of the swim training apparatus opposite the coupling section, wherein the buoy section has a buoy slot defined therein, the buoy slot configured to allow the buoy line to be positioned therein when the swim training apparatus is in the first orientation.

DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

DETAILED DESCRIPTION

The above-mentioned aspects of the present application and the manner of obtaining them will become more apparent and the teachings of the present application itself will be better understood by reference to the following description of the embodiments of the present application taken in conjunction with the accompanying drawings.

Figure 1:
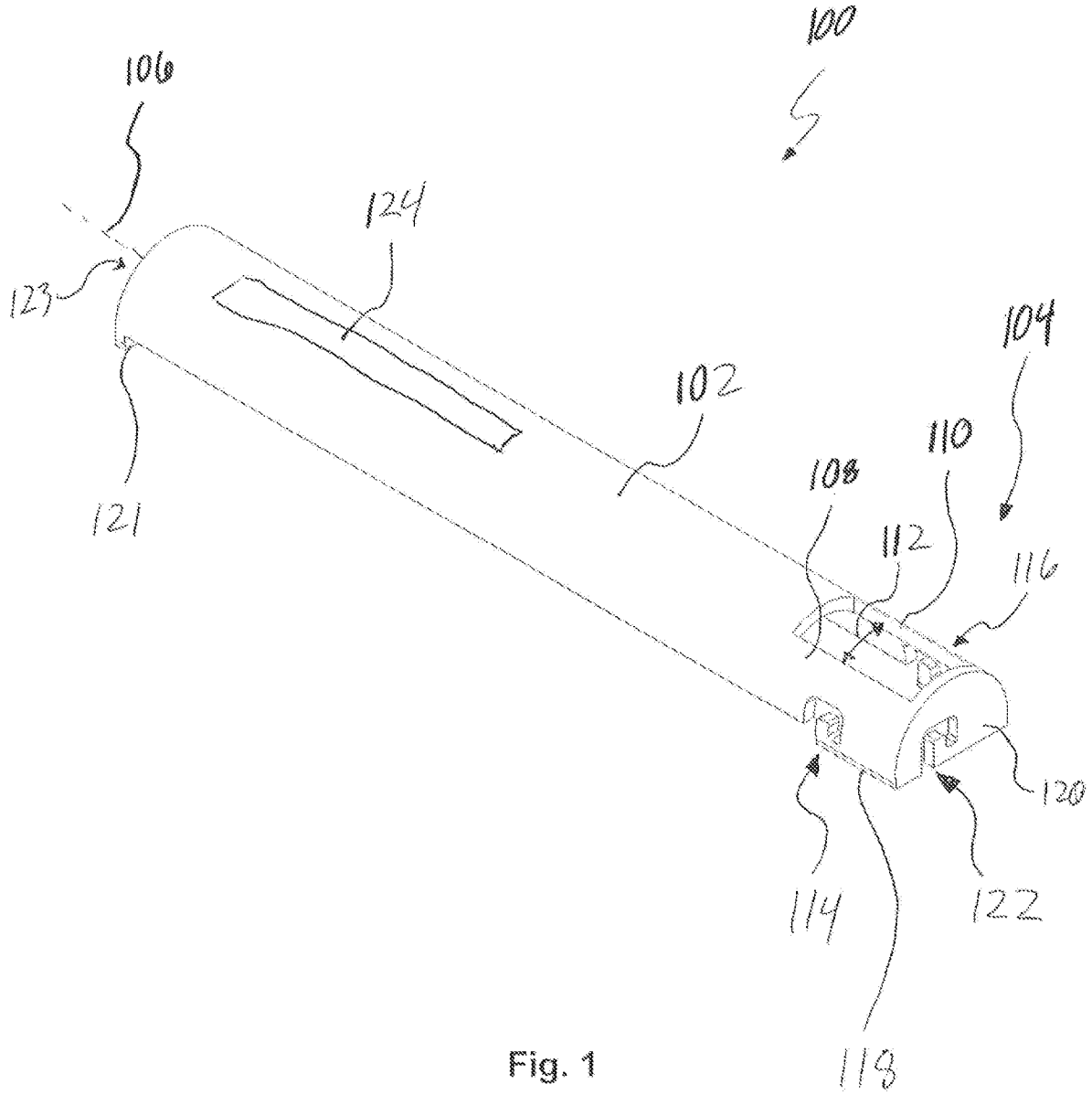
FIG. 1 is an elevated perspective view of a swim training apparatus.
Figure 2:
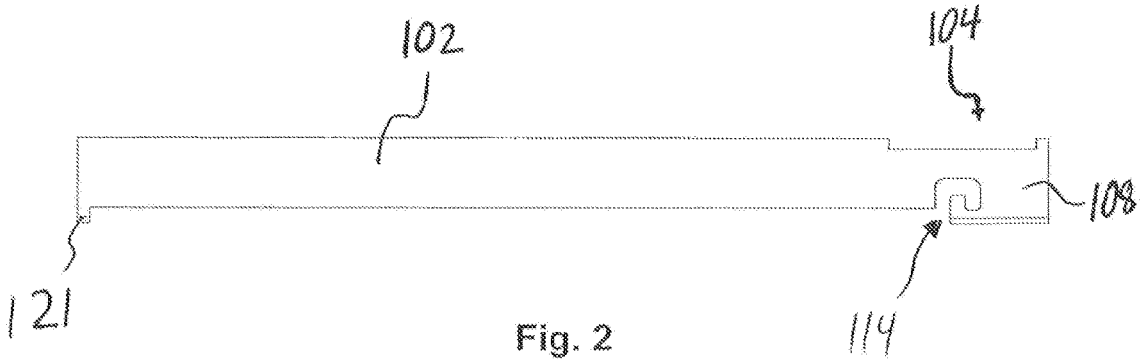
FIG. 2 is a side view of the swim training apparatus of FIG. 1.
Figure 3:
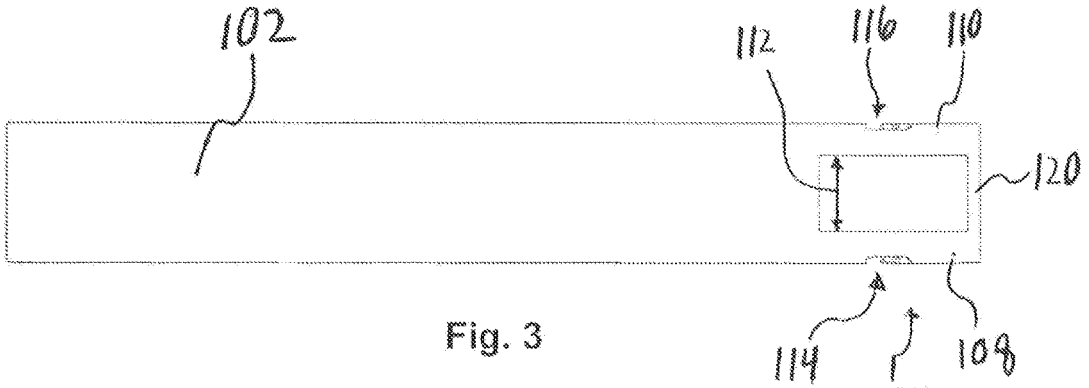
FIG. 3 is a top view of the swim training apparatus of FIG. 1.
Figure 4:
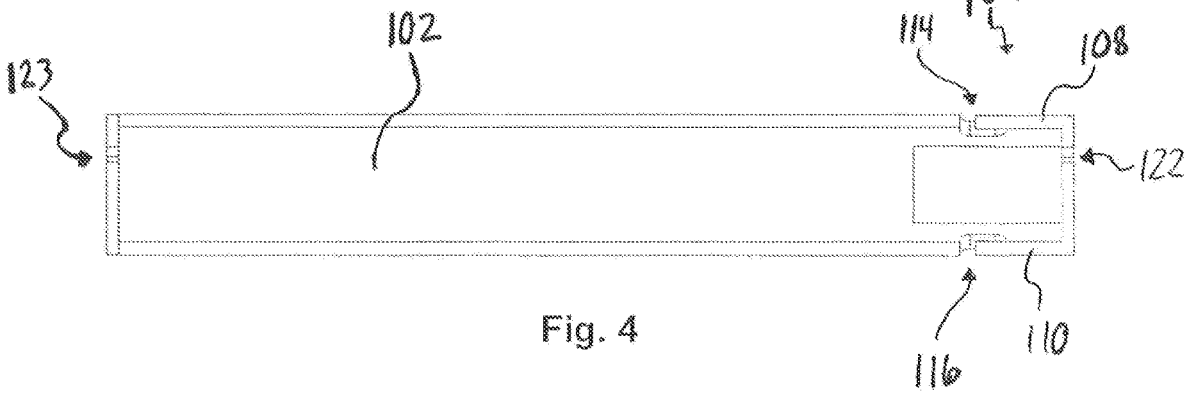
FIG. 4 is a bottom view of the swim training apparatus of FIG. 1.
Figure 5:
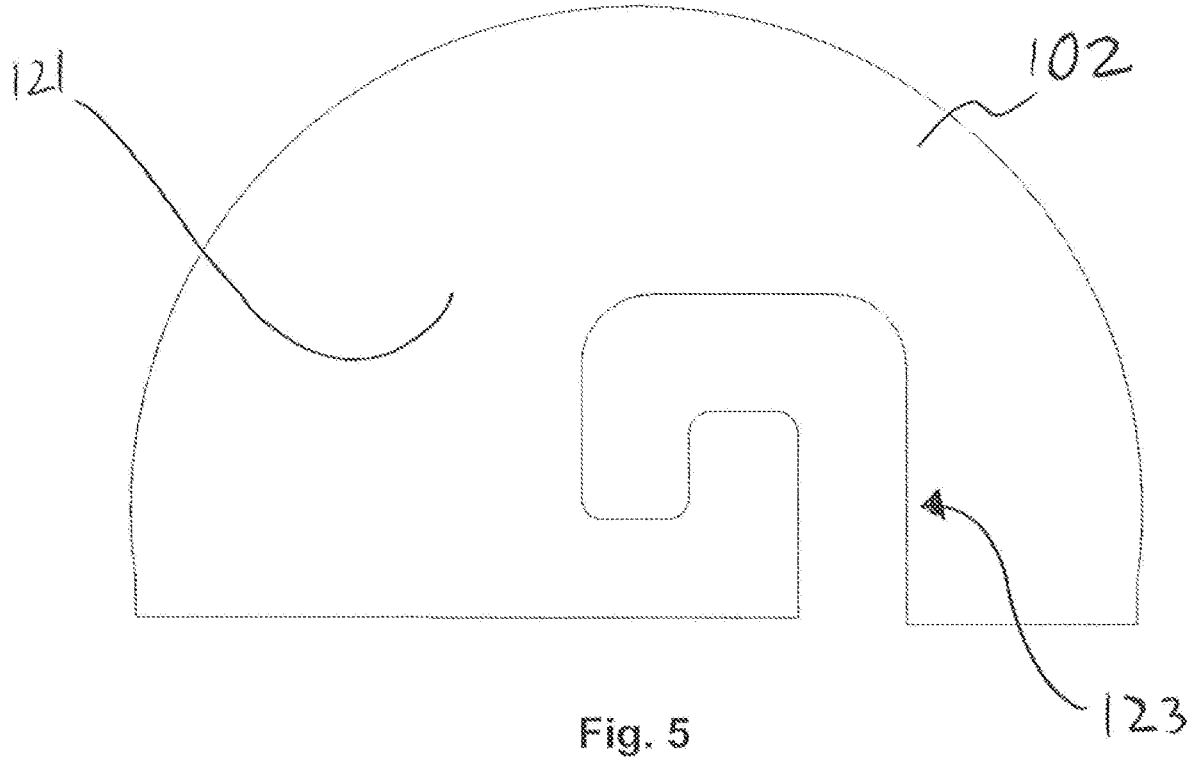
FIG. 5 is a front view of the swim training apparatus of FIG. 1.
Figure 6:
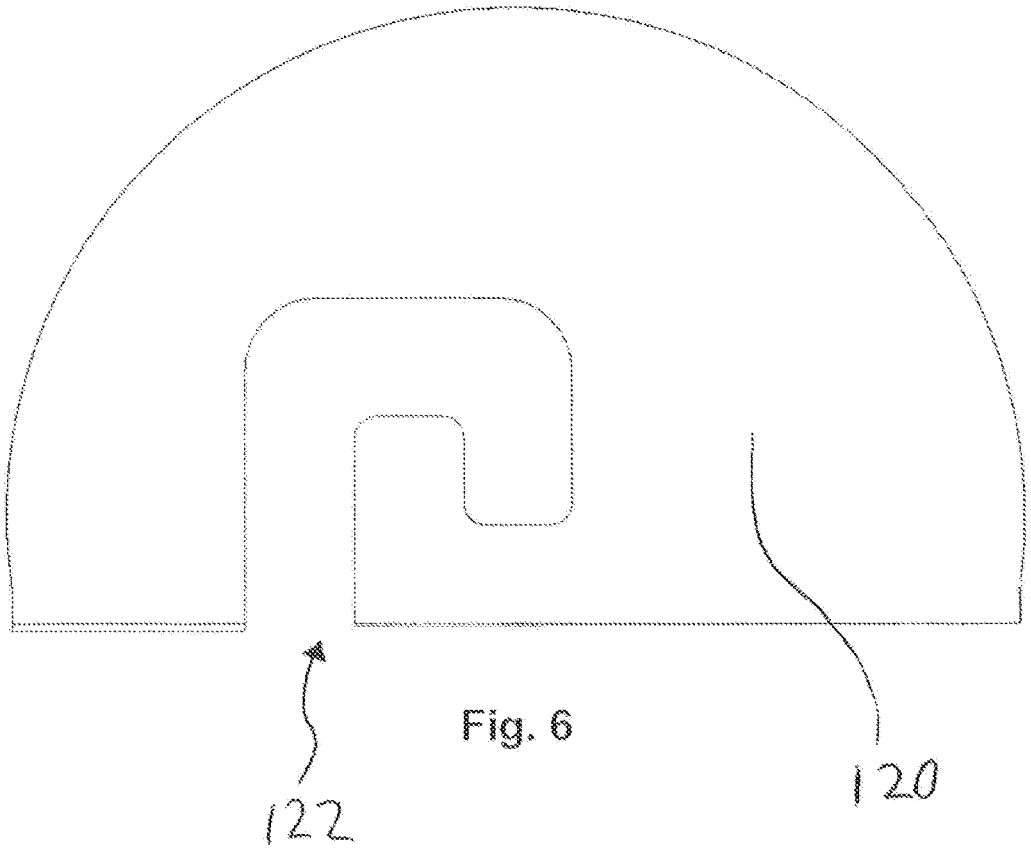
FIG. 6 is a back view of the swim training apparatus of FIG. 1.
Figure 7:
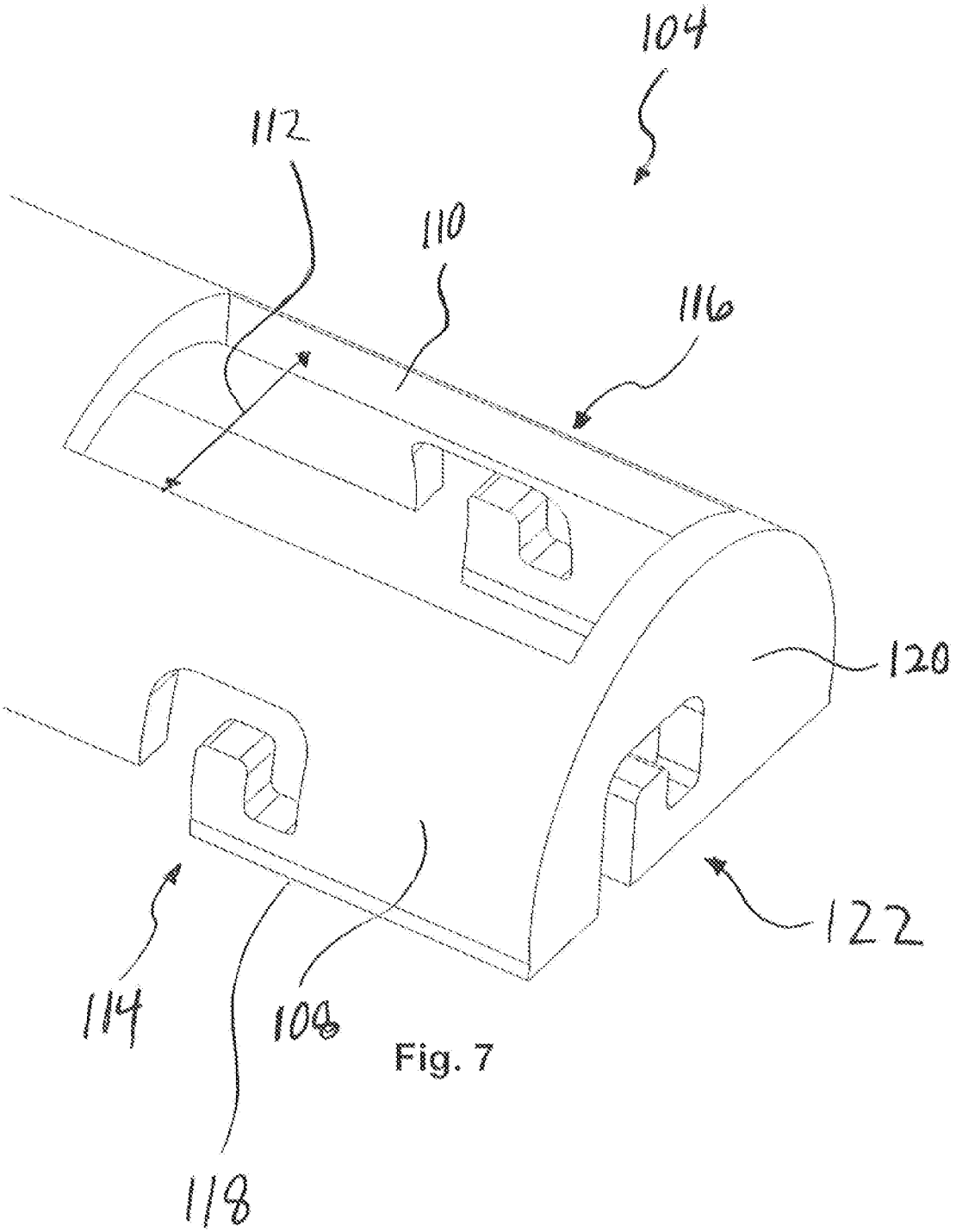
FIG. 7 is an elevated section view of one end of the swim training apparatus of FIG. 1.
Figure 8:
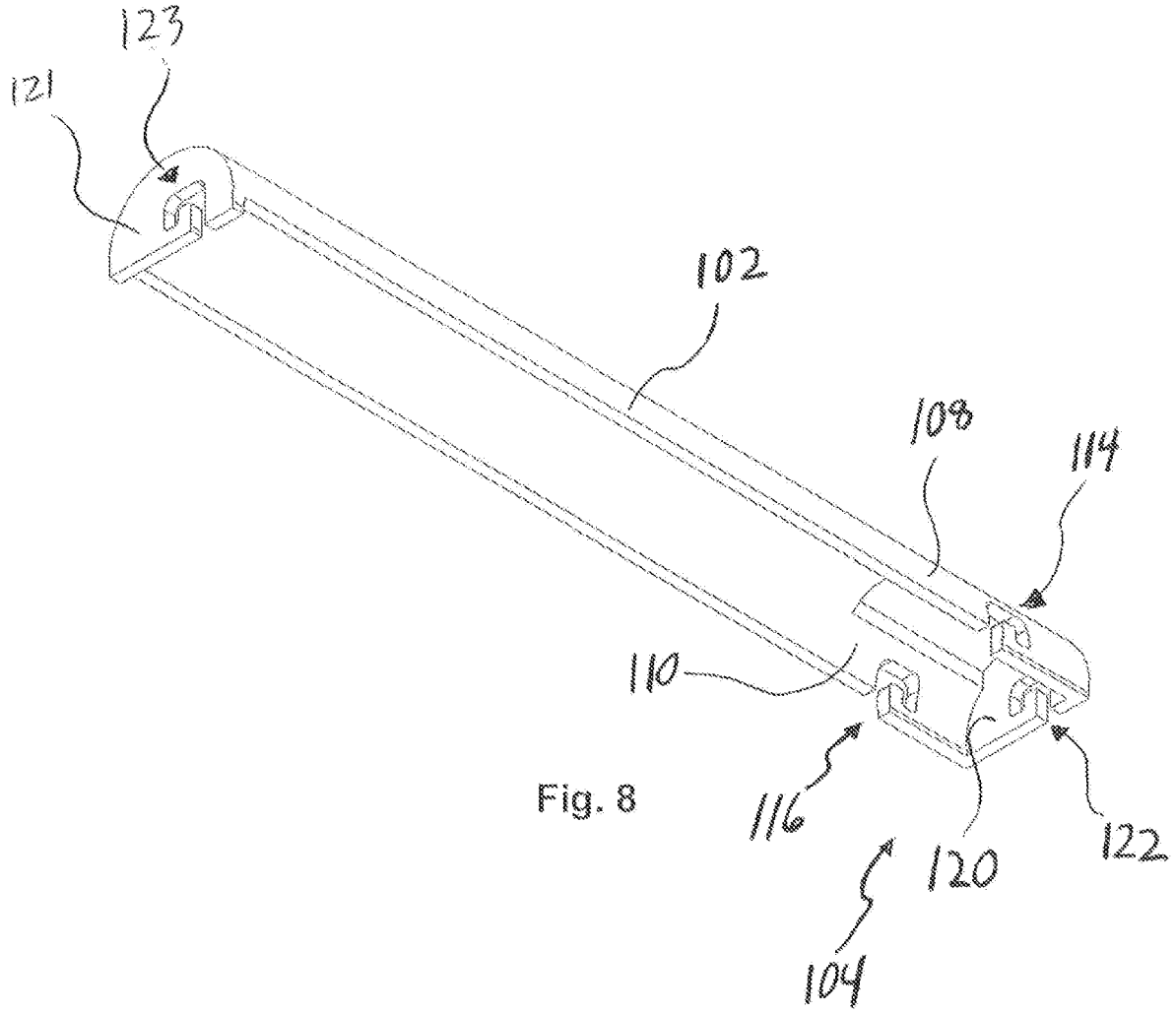
FIG. 8 is a lowered perspective view of the swim training apparatus of FIG. 1.

One embodiment of a swim training apparatus 100 of the present disclosure is illustrated in FIG. 1. The swim apparatus 100 has a body section 102 and a coupling section 104 defined along a longitudinal axis 106. The coupling section 104 may be a separate component coupled to the body section 102 or the coupling section 104 may be formed with the body section in a single manufacturing process. In other words, the coupling section 104 and the body section 102 may be integrally formed as a single unitary structure.

Figure 9:
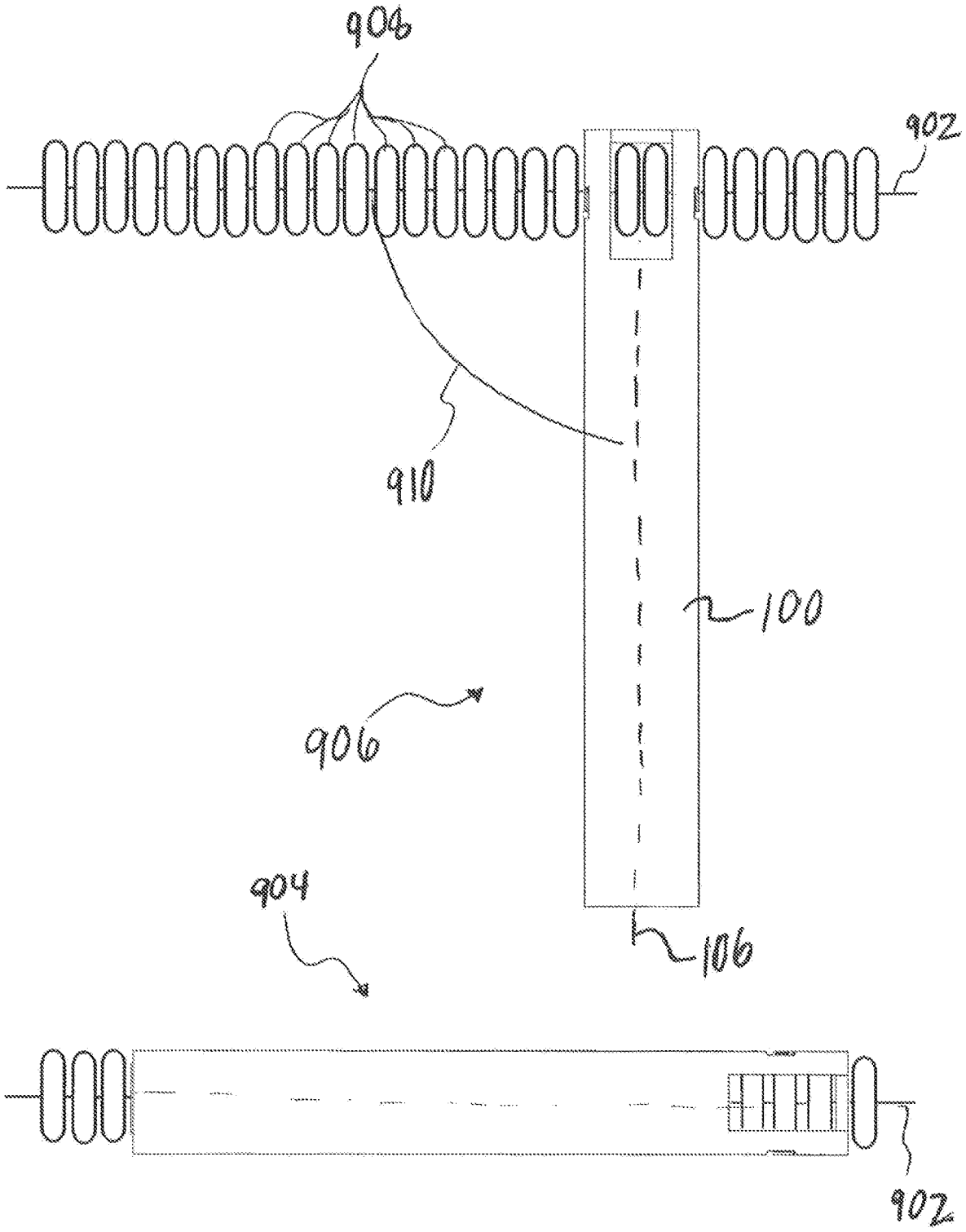
FIG. 9 is adjacent swim training apparatuses coupled to adjacent buoy lines in alternative configurations.

The swim training apparatus 100 is configured to be coupled to a buoy line 902 in either a first orientation 904 or a second orientation 706 (See FIG. 9). The first orientation 904 may be such that the longitudinal axis 106 is substantially parallel with the buoy line 902. In the first orientation 904, the swim training apparatus 904 is positioned along, and at least partially over, one or more buoy 908 on the buoy line 902. Accordingly, in the first orientation the swim training apparatus 100 does not substantially obstruct the adjacent swim lane.

However, in the second orientation 906, the swim training apparatus 100 is oriented such that the longitudinal axis 106 is about perpendicular to the buoy line 902 so at least a portion of the swim training apparatus 100 extends into the adjacent swim lane. As will be discussed in more detail herein, the swim training apparatus 100 is configured to be positioned in either the first orientation 904 to be stored along the buoy line 902 or the second orientation 906 to be a marker in the adjacent swim lane to facilitate training exercises among other things.

The body section 102 may have a substantially concave cross section to allow buoys 908 to be partially positioned in a cavity of the body section 102 when in the first orientation 904. Similarly, the coupling section 104 may be formed of a first leg 108 and a second leg 110, each having an arc-shaped profile sized to allow a buoy 908 to be at least partially positioned there between.

The first and second legs 108, 110 of the coupling section 104 may extend from the body section 102 and be separated from one another by a gap 112. The gap 112 may be sufficiently large to allow one or more buoy 908 to be positioned therein when in the second orientation 906. Further, the first leg 108 may define a first slot 114 and the second leg 110 may define a second slot 116 therein. The first and second slots 114, 116 are sized to allow the buoy line 902 to become selectively positioned therein to selectively maintain the swim training apparatus 100 in the second orientation 906. In one aspect of this disclosure, the first and second slots 114, 116 have an inverted J-shaped profile. With this profile, a user may guide the buoy line 902 through the corresponding slots 114, 116 until it reaches a terminus. Once the buoy line 902 has reached the terminus, the buoyancy of the coupling section 104 may sufficiently prevent the buoy line 902 from leaving the terminus of the slots 114, 116 and the swim training apparatus may be maintained in the second orientation. In one aspect of this disclosure, a chamber along the J-shaped profile may further direct the buoy line into the terminus.

To further prevent the swim training apparatus 100 from unintentionally being uncoupled from the buoy line 902 when in the second orientation 906, each leg 108, 110 may have an elongated side section 118. The elongated side section 118 may be a buoyant material that extends further into any adjacent water than the body section 102. The elongated section 118 may provide additional buoyancy to prevent the buoy line 902 from unintentionally leaving the corresponding slots 114, 116.

The coupling section 104 may also have a buoy section 120 at a distal end of the first and second legs 108, 110. The buoy section 120 may span the gap 112 and couple the first leg 108 to the second leg 110 at their corresponding distal ends. A buoy section 121 may also be positioned at the opposite side of the body section 102 relative to the buoy section 120.

Further, the buoy section 120 may have a buoy slot 122 defined therein and buoy section 121 may have a buoy slot 123 defined therein. The buoy slots 122, 123 may be similar to the first and second slot 114, 116 but rotated about ninety degrees relative thereto. In this configuration, the opening of the buoy slots 122, 123 may be aligned such that the buoy line 902 can be positioned there through along the longitudinal axis 106 to selectively retain the swim training apparatus 100 in the first orientation 704. Further, in one contemplated embodiment the buoy slots 122, 123 may have a J-shaped through hole and be configured to retain the buoy line 902 in a terminus similar to the slots 114, 116 discussed herein.

While the buoy sections 120, 121 are illustrated at the coupling section 104 and the opposing end of the body section 102, in another embodiment only one buoy section 120, 121 may be positioned one end of the body section 102 and there not be a buoy section 120, 121 at the opposite end.

In use, a user may selectively position the swim training apparatus 100 in either the first orientation 904 or the second orientation 906 based on the user's needs. For example, if the user wants to swim freely in the adjacent swim lane, they may position the swim training apparatus 100 in the first position 904 by aligning the longitudinal axis 106 with the buoy line 902 and positioning the buoy section 120 between gaps in adjacent buoys 908. Once the buoy section 120 is positioned within a gap between buoys 908, the buoy line 902 may be positioned in the terminus of the slot 122 by at least partially submerging the coupling section 104. After positioned in the terminus of the slot 122, the buoy line 902 may be substantially maintained in that position due to the buoyancy of the coupling section 104.

If the user wants to reposition the swim training apparatus in the second orientation 906 from the first orientation 904, the user may press the coupling section 104 farther into the water to overcome the buoyant force keeping the buoy line 902 in the terminus of the slot 122. The user may then guide the buoy line 902 out of the slot 122 so the swim training apparatus 100 is no longer coupled to the buoy line 902. At this point, the user may rotate the swim training apparatus 100 so it is repositioned at an offset angle 910 from the buoy line 902. Typically, the offset angle 910 would be between about eighty-five degrees and ninety-five degrees. However, other offset angles 910 are also contemplated herein. In other considered embodiments the offset angle 910 is any angle that allows the swim training apparatus 110 to be at least partially positioned in the swim lane in the second orientation 906.

Once positioned at the offset angle 910, the first and second legs 108, 110 may be positioned in gaps of buoys 908 on the buoy line 902. Further, one or more buoy 908 may be positioned within the gap 112 defined between the first and second leg 108, 110. Once the legs are properly positioned in gaps, the buoy line 902 may be guided into the corresponding terminuses of the first and second slot 114, 116. Once positioned within the terminus of each slot 114, 116, the swim training apparatus 100 may be substantially coupled to the buoy line 902 in the second orientation 906. Further, the buoyancy of the coupling section 104 may substantially prevent the buoy line 902 from exiting the corresponding slots 114, 116 until a user intentionally submerges a portion of the coupling section 104 to remove the buoy wire from the slots 114, 116.

The swim training apparatus 100 may be formed of one or more buoyant materials. In one example, the swim training apparatus 100 is made of polyethylene. In another example, the swim training apparatus 100 may be formed of expanded polypropylene ("EPP") foam. Alternatively, any closed-cell foam that is impact resistant, water resistant, and buoyant may be used. However, this disclosure also contemplates using any other buoyant material that may or may not be formed of foam. Further still, one contemplated embodiment uses non-buoyant material having a second buoyant material coupled thereto.

In another aspect of this disclosure, the body section 102 may have an indicia section 124 configured to receive and display advertisements or other information. The indicia section 124 may have indicia printed thereon or be a planar or a curved surface that can receive indicia to be displayed.

Figure 10:
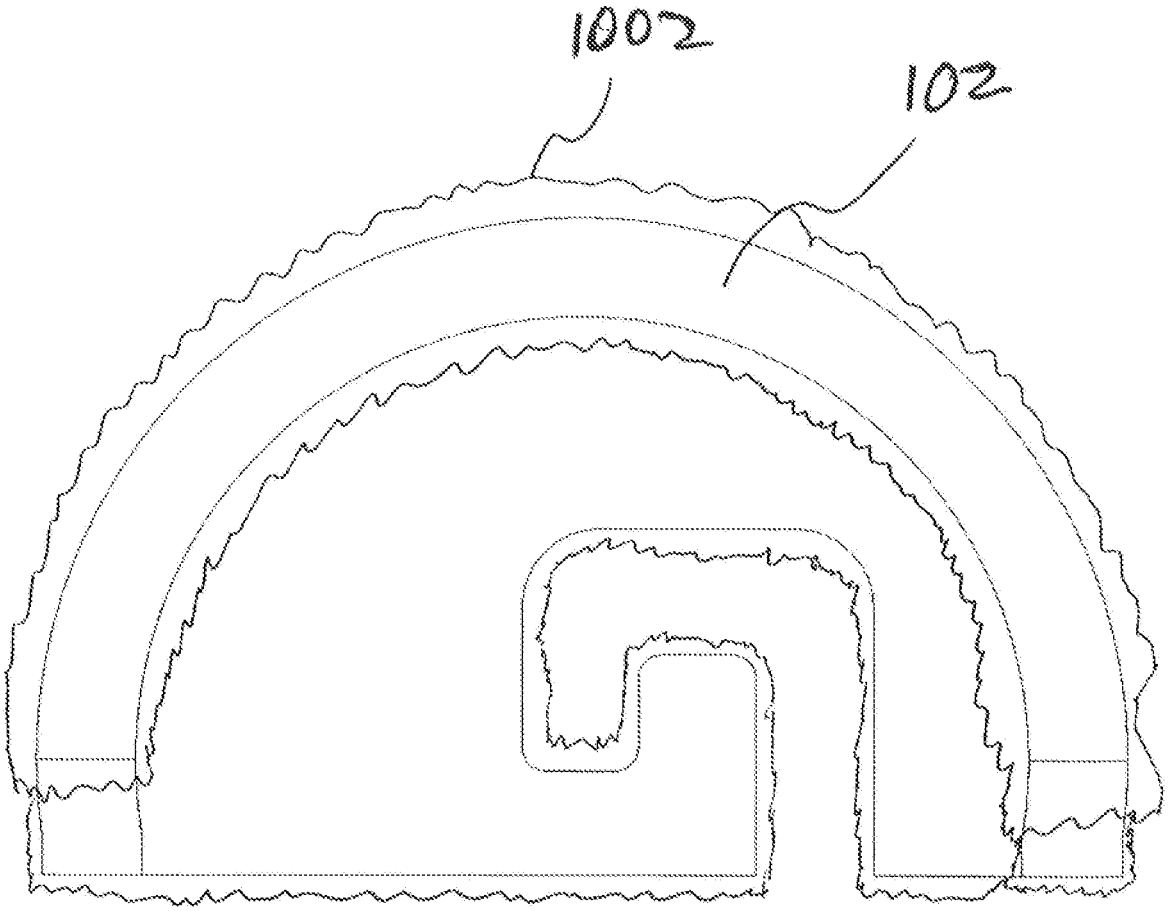
FIG. 10 illustrates a cross-section view of one embodiment of a swim training apparatus having an outer coating.

Referring now to FIG. 10, another embodiment of the present disclosure is illustrated from a mid-section view. More specifically, FIG. 10 illustrates an outer coating 1002 around the core portion of the swim training apparatus 100. In this embodiment, encasing the core portion of the swim training apparatus 100 with the outer coating 1002 may protect the swim training apparatus 100 from ripping during install, transport, or use. In one aspect of this disclosure, the outer coating 1002 may be formed of a nylon material. Further, the foam portion of the swim training apparatus 100 may be made of EVA or EPP foam. Further still, the swim training apparatus 100, 1100 may be formed of a combination of materials. For example, a body section 1102 may be formed of a foam material while a buoy section 1121 may be formed of a EVA plastic or vice versa.

Figure 11:
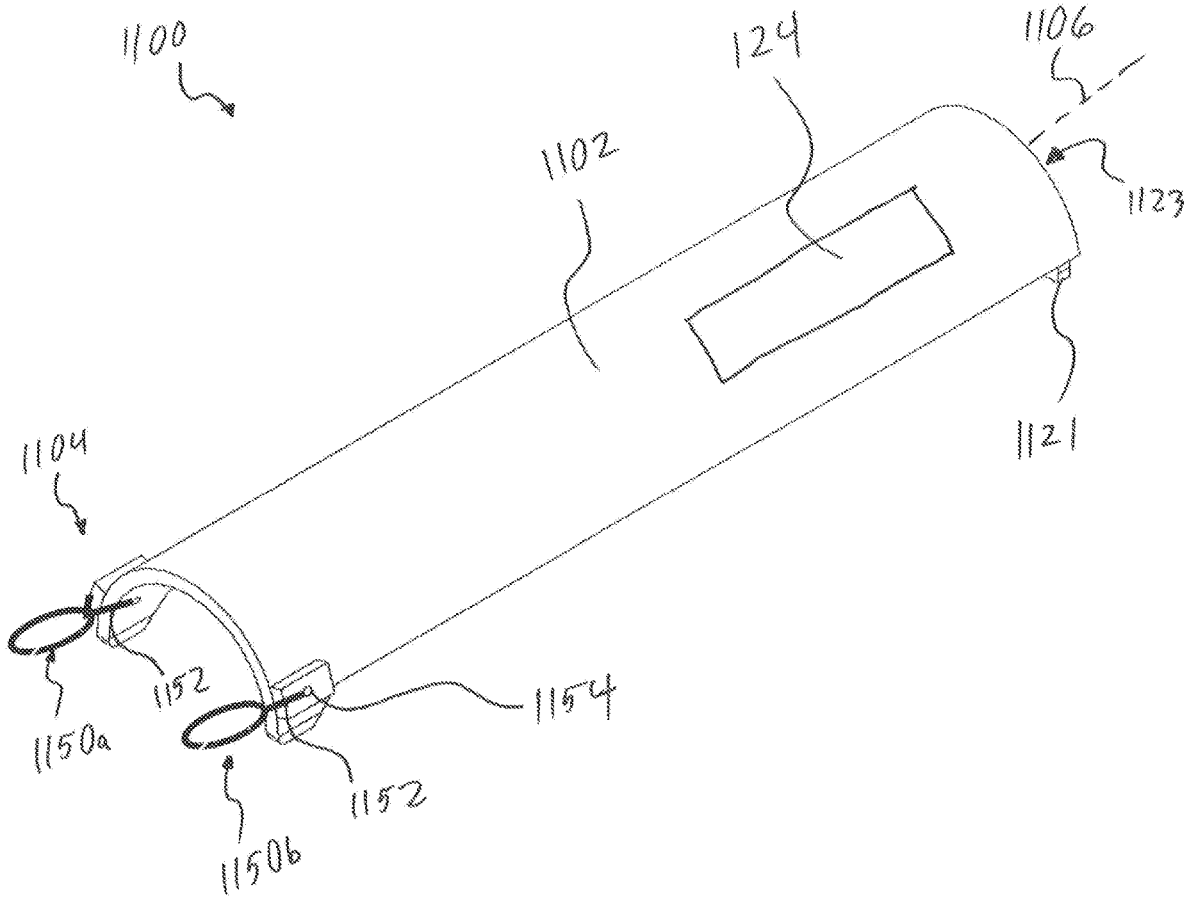
FIG. 11 is an elevated perspective view of another embodiment of a swim training apparatus.
Figure 12:
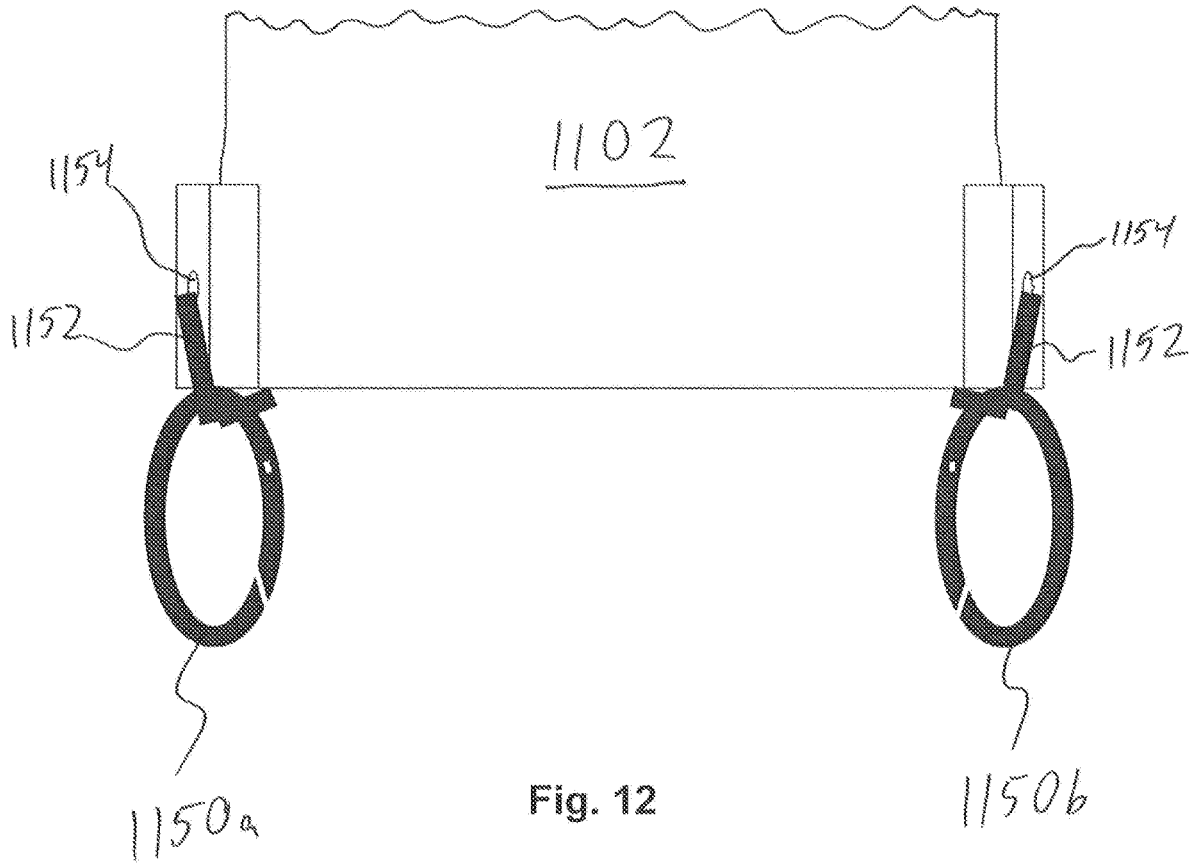
FIG. 12 is a detailed section top view of one end of the swim training apparatus of FIG. 11.
Figure 13:
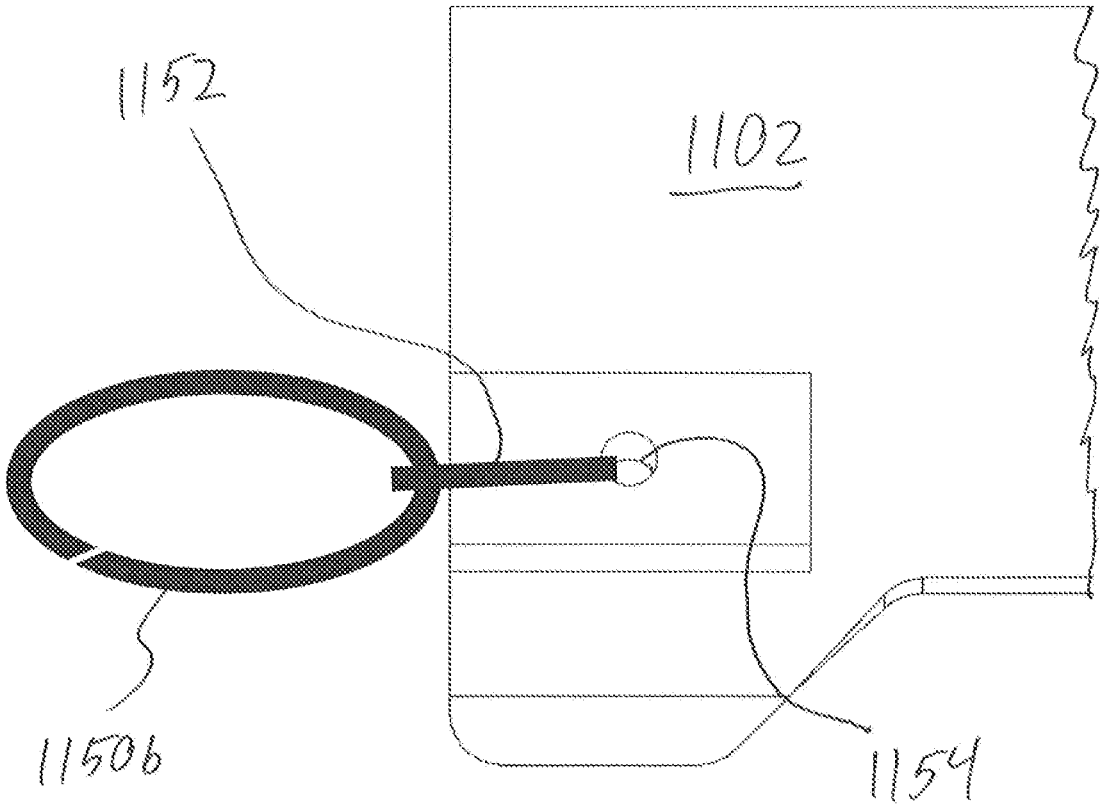
FIG. 13 is a detailed section side view of the swim training apparatus of FIG. 11. Corresponding reference numerals are used to indicate corresponding parts throughout the several views.

Referring now to FIGS. 11-13, another embodiment of a swim training apparatus 1100 is illustrated. The swim training apparatus 1100 may have a body section 1102 and buoy section 1121 substantially similar to the swim training apparatus 100 discussed herein. The buoy section 1121 may have a buoy slot 1123 similar to the buoy slot 123 for the swim training apparatus 100. However, a coupling section 1104 of the swim training apparatus 1100 may utilize clips 1150*a*, 1150*b* to selectively couple the swim training apparatus 1100 to the buoy line 902 instead of the slots 114, 116 described herein for the swim training apparatus 100. The clips 1150*a*, 1150*b* may have a springed opening wherein the clips 1150*a*, 1150*b* can be selectively pivoted to an open configuration wherein the buoy line 904 can be selectively positioned and retained by the clips 1150*a*, 1150*b*. In one example, the clips 1150*a*, 1150*b* may be carabiner style clips.

The clips 1150*a*, 1150*b* may be coupled to the bode section 1102 through one or more line 1152. The line 1152 may pass through a through hole 1154 defined through the body section 1102 such that the clip 1150*a*, 1150*b* is coupled to the body section 1102 through the line 1152. The clips 1150*a*, 1150*b* and line 1152 are sized so the clip 1150*a*, 1150*b* can be fastened to the buoy line 904 so one or more buoy 908 may be positioned between the clips 1150*a*, 1150*b*. Further, the clips 1150*a*, 1150*b* and corresponding line 1152 are sized such that the body section 1102 is adjacent to the buoys in the second orientation 906 to maintain the swim training apparatus 1100 in the desired position when in the second orientation 906.

In one aspect of this disclosure, the line 1152 may be formed of an elastic material such that the clips 1150*a*, 1150*b* can be extended away from the body section 1102 to clip to the buoy line 902. Alternatively, the line 1152 may have an adjustable length and not be substantially elastic. In yet another embodiment, the line 1152 may have an adjustable length and be made of an elastic material. In one aspect of this disclosure, the line 1152 may be formed of a stainless steel wire covered in nylon. Accordingly, many different materials and material properties are considered herein for the line 1152.

The line 1152 may pass through the through hole 1154 of the body section 1102. The through hole 1154 may extend entirely through the body section 1102 so the line 1152 may be wrapped around an end of the body section 1102 to couple the corresponding clip 1150*a*, 1150*b* thereto. The through hole 1154 may also have a liner about the through hole wall so that the line 1152 does not tear into the body section 1102. The liner may be a tube section of a more rigid plastic or metal and may be glued into the body section 1102 or positioned into the body section 1102 through a friction fit.

In use, the swim training apparatus 1100 may be positioned so the longitudinal axis 1106 is aligned with an underlying buoy line 902. The swim training apparatus 1100 may be positioned partially around buoys 908 on the buoy line 902 and the buoy line 902 may be positioned in the buoy slot 1123 of the buoy section 1121 as described herein for the buoy slot 123 of the swim training apparatus 100. The clips 1150*a*, 1150*b* may then be clipped to the buoy line 902 or to each other underneath the buoy line 902. In this configuration, the swim training apparatus 1100 is aligned with the buoy line 902 and at least partially positioned around the buoys 908 such that the swim training apparatus 1100 does not substantially extend into the swim lane. The buoy slot 1123 my keep one end of the swim training apparatus 1100 coupled to the buoy line 902 while the clips 1150*a*, 1150*b* may keep the other end of the swim training apparatus coupled to buoy line 902.

The swim training apparatus 1100 may be positioned in the second orientation 906 by removing the buoy line from the buoy slot 1123 and uncoupling the clips 1150*a*, 1150*b* from the buoy line 902 or one another. Once the swim training apparatus is uncoupled from the buoy line 902, it may be positioned in the second orientation 906 such that the longitudinal axis 1106 is offset from the buoy line 902. In one embodiment considered herein, the longitudinal axis 1106 is about perpendicular to the buoy line 902 in the second orientation 906. Regardless, once the swim training apparatus 1100 is in the second orientation 906, the clips

1150*a*, 1150*b* may be clipped to the buoy line 902, positioning one or more buoy 908 there between. The clips 1150*a*, 1150*b* are spaced such that they substantially hold the swim training apparatus 1100 in the second orientation 906 to be used as a marker for swim training among other things.

While an exemplary embodiment incorporating the principles of the present application has been disclosed hereinabove, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations).

Throughout this disclosure, various quantities, such as amounts, sizes, dimensions, proportions and the like, are presented in a range format. It should be understood that the description of a quantity in range format is merely for convenience and brevity and should not be construed as an inflexible limitation on the scope of any embodiment. Accordingly, the description of a range should be considered to have specifically disclosed all the possible subranges as well as all individual numerical values within that range unless the context clearly dictates otherwise. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual values within that range, for example, 1.1, 2, 2.3, 4.62, 5, and 5.9. This applies regardless of the breadth of the range. The upper and lower limits of these intervening ranges may independently be included in the smaller ranges, and are also encompassed within the disclosure, subject to any specifically excluded limit in the stated range. Where the stated range includes one or both of the limits, ranges excluding either or both of those included limits are also included in the disclosure, unless the context clearly dictates otherwise.

Unless specifically stated or obvious from context, as used herein, the term "about" in reference to a number or range of numbers is understood to mean the stated number and numbers +/−10% thereof, or 10% below the lower listed limit and 10% above the higher listed limit for the values listed for a range.

What is claimed is:

1. A swim training apparatus, comprising:

a body section defined along a longitudinal axis; and a coupling section configured to couple the swim training apparatus to a buoy line in a first orientation and a second orientation;

wherein, in the first orientation the longitudinal axis of the body section is substantially parallel with the buoy line and in the second orientation the longitudinal axis of the body section has an offset angle relative to the buoy line;

wherein the coupling section has elongated side sections relative to the body section configured to increase the buoyancy of the coupling section.

2. The swim training apparatus of claim 1, further wherein the offset angle is between about eighty-five degrees and about ninety-five degrees.

3. The swim training apparatus of claim 1, further wherein the coupling section comprises a first leg and a second leg;

wherein the first leg has a first slot and the second leg has a second slot, the first and second slot configured to allow the buoy line to be positioned therein when the swim training apparatus is in the second orientation;

wherein the first and second slot have an inverted J-shaped profile.

4. The swim training apparatus of claim 3, further wherein the first and second leg are separated by a gap sized to allow at least one buoy on the buoy line to be positioned therein when the swim training apparatus is in the second orientation.

5. The swim training apparatus of claim 4, further comprising a buoy section spanning the first leg and the second leg, wherein the buoy section has a buoy slot having an inverted J-shaped profile defined therein, the buoy slot configured to allow the buoy line to be positioned therein when the swim training apparatus is in the first orientation.

6. The swim training apparatus of claim 1, wherein the body section has a concave cross-section configured to allow a four-inch buoy to be positioned at least partially therein in the first orientation.

7. The swim training apparatus of claim 1, wherein the swim training apparatus is formed of a buoyant material.

8. The swim training apparatus of claim 1, further comprising an indicia section on the body section configured to display advertising indicia.

9. The swim training apparatus of claim 1, wherein the body section has a concave cross-section configured to allow a six-inch buoy to be positioned at least partially therein in the first orientation.

10. The swim training apparatus of claim 9, further wherein the swim training apparatus is formed of expanded polypropylene foam.

11. The swim training apparatus of claim 1, further comprising an outer coating substantially surrounding the outer surface of the swim training apparatus, wherein the outer coating is formed of a different material than the body section.

12. The swim training apparatus of claim 1, further comprising a buoy section at one of a first end or a second end of the swim training apparatus.

13. The swim training apparatus of claim 12, further wherein the buoy section has a buoy slot defined therein, the buoy slot configured to allow the buoy line to be positioned therein when the swim training apparatus is in the first orientation.

14. A swim training apparatus, comprising:

a body section defined along a longitudinal axis; and a coupling section configured to couple the swim training apparatus to a buoy line in a first orientation and a second orientation;

wherein, in the first orientation the longitudinal axis of the body section is substantially parallel with the buoy line and in the second orientation the longitudinal axis of the body section has an offset angle relative to the buoy line;

wherein the coupling section comprises a first and second clip configured to be selectively coupled to the buoy line, wherein the first and second clip are both coupleable to the buoy line in both the first orientation and the second orientation;

wherein each of the first and second clip is coupled to the body section with a line.

15. The swim training apparatus of claim 14, wherein the line is coupled to the body section through a through hole.

16. The swim training apparatus of claim 14, further comprising a buoy section at one end of the swim training apparatus opposite the coupling section, wherein the buoy section has a buoy slot defined therein, the buoy slot configured to allow the buoy line to be positioned therein when the swim training apparatus is in the first orientation.

17. The swim training apparatus of claim 14, further wherein a buoy section is at both the first end and the second end, wherein each buoy section has a buoy slot with an inverted J-shaped profile defined therein, the buoy slot configured to allow the buoy line to be positioned therein when the swim training apparatus is in the first orientation.

18. The swim training apparatus of claim 17, wherein an outer coating is formed of nylon.

* * * * *